United States Patent [19]

Iwata et al.

[11] Patent Number: 4,526,627

[45] Date of Patent: Jul. 2, 1985

[54] METHOD AND APPARATUS FOR DIRECT HEAT TREATMENT OF MEDIUM- TO HIGH-CARBON STEEL RODS

[75] Inventors: Hitoshi Iwata; Yoshihiro Hashimoto; Katsuhiko Yamada, all of Hyogo, Japan

[73] Assignee: Sumitomo Electric Industries, Limited, Japan

[21] Appl. No.: 613,485

[22] Filed: May 24, 1984

[30] Foreign Application Priority Data

May 24, 1983 [JP] Japan ..... 58-91923
Oct. 28, 1983 [JP] Japan ..... 58-203160

[51] Int. Cl.[3] ..... C21D 8/08; C21D 1/64

[52] U.S. Cl. ..... 148/12 B; 148/156; 266/106; 266/131

[58] Field of Search ..... 266/106, 111, 112, 131; 261/87, 93; 148/12 B, 12.4, 18, 156

[56] References Cited

U.S. PATENT DOCUMENTS 3,494,603 2/1970 Hill ..... 148/156
3,718,024 2/1973 Vitelli ..... 266/106
3,788,618 1/1974 Van der Bulcke ..... 266/106
4,150,816 4/1979 Properzi ..... 266/106
4,170,494 10/1979 Fujii et al. ..... 148/12 B
4,313,898 2/1982 Schürch ..... 261/93
4,395,022 7/1983 Paulus et al. ..... 266/131
4,415,143 11/1983 Ebata ..... 266/112

FOREIGN PATENT DOCUMENTS 137946 10/1979 Fed. Rep. of Germany .... 148/12 B
92313 8/1978 Japan ..... 266/112

*Primary Examiner*—Peter K. Skiff
*Attorney, Agent, or Firm*—Sughrue, Mion, Zinn, Macpeak and Seas

[57] ABSTRACT

A method and apparatus for the direct heat treatment of medium- to high-carbon steel rods which provides an increased tensile strength and drawability by subjecting hot-rolled steel rods to controlled cooling with a coolant. Expanded spiral coils of hot-rolled medium- to high-carbon steel rod having an austenitic structure and which is continuously transported in a generally horizontal direction is cooled by passing the spiral coils through a vessel containing a coolant of a gas bubble-water mixed fluid under a strong turbulent action. The coolant fluid contains a uniform dispersion of oxidizing gas bubbles and is maintained at a temperature of not higher than 95° C. Preferably, the coolant is caused to flow in the same direction as the direction of movement of the coil in the vessel. The surface of the rod may be oxidized by allowing it to cool in air before it is immersed in the coolant fluid.

29 Claims, 17 Drawing Figures

11.5 ø
0.81 C
0.25 Si
0.66 Mn
0.04 Cr

| TEMPERATURE OF COOLANT (°C) | COOLANT FLOW | | AIR BLOWING |
|---|---|---|---|
| | PARALLEL TO ROD AXIS | NORMAL TO ROD AXIS | |
| 100 | ⊙ | ⊙ | NONE |
| 85 | ▲ | △ | YES |
| 80 | ● | ○ | YES |

x14000

950°C x 15min (IN $N_2$ GAS)

PERIOD OF AERIAL OXIDATION 5.1sec

93°C { Ar GAS / GAS BUBBLE-WATER MIXED FLUID

950°C x 15min (IN $N_2$ GAS)

40 sec

93°C { AIR / GAS BUBBLE-WATER MIXED FLUID

950°C x 15min (IN $N_2$ GAS)

4.4 sec

93°C WARM WATER

METHOD AND APPARATUS FOR DIRECT HEAT TREATMENT OF MEDIUM- TO HIGH-CARBON STEEL RODS

BACKGROUND OF THE INVENTION

The present invention relates to an improved method and apparatus for producing medium- to high-carbon steel rods for use as springs and tensioning members, either twisted or untwisted, in prestressed concrete (PC). More particularly, the present invention relates to an improvement in the method of "direct heat treatment" for producing steel rods having increased tensile strength and drawability by subjecting hot-rolled steel rods to controlled cooling with a coolant.

The essence of the direct heat treatment of a medium- to high-carbon steel rod is cooling a coil of the rod substantially uniformly along the entire coil length at a suitable cooling rate so as to provide a fine pearlitic microstructure. Since the treated rod has strength and drawability properties comparable to those of a patented rod, it can be immediately drawn without patenting if the rod diameter and the specifications for the required quality so permit. However, rods used to manufacture PC tensioning members must have a large diameter and high strength, and the rod obtained by the conventional direct heat treatment has a tensile strength which is about 10 kg/mm$^2$ lower than that of a rod that has been patented through a lead bath. Furthermore, the rods treated by the conventional direct method have a low uniformity in strength. For these reasons, patenting through a lead bath is essential in the process of manufacturing large-diameter rods for use as PC tensioning members.

Several methods have been proposed for the direct heat treatment of medium- to high-carbon steel rods, which methods have various merits and demerits as discussed below. First, the Stelmor method wherein a spiral coil expanded on a horizontal conveyor is cooled with an air blast (Japanese Patent Publication No. 15463/67) provides a rod having a reasonably uniform quality without local quenching. However, the cooling action of this method is rather weak and the resulting rod does not have a sufficient strength. The air blast does not effectively cool the overlapping portions of adjacent turns of coil, and this causes nonuniformity in the rod's strength. The second method wherein a spiral coil of rod is wound in warm water (Japanese Patent Publication No. 8536/70) or transported on a horizontal conveyor moving through warm water (Japanese Patent Publication No. 8089/71) provides a rod having a uniform quality if boiling water is used as the cooling medium. However, the product has an insuffucient tensile strength 10 kg/m$^2$ lower than the value obtained by patenting through a lead bath, and even the tensile strength of a rod that is treated by an additional vigorous agitation with air injection (as shown in Japanese Patent Application (0PI) No. 9826/82) is 5 to 7 kg/mm$^2$ lower than the value obtained by patenting through a lead bath. The use of subcooled boiling water (95° C.) has also been proposed, and this is effective in providing increased rod strength. However, this method is not capable of producing stable film boiling, and even at elevated temperatures higher than the pearlite transformation range, nucleate boiling occurs, and the resulting local quenching yields a martensite structure, which is of course detrimental to the intended object of producing a steel rod having improved tensile strength and drawability.

SUMMARY OF THE INVENTION

The primary object of the present invention is to provide a method and apparatus for direct heat treatment that is capable of producing a medium- to high-carbon steel rod by cooling with subcooled boiling water at a necessary and sufficient cooling rate that can be achieved through film boiling alone without inducing nucleate boiling. The treated rod has a strength comparable to that achieved by patenting through a lead bath, and its deviation is less than that occurring in the conventionally treated rod. In addition to this uniformity in quality, the rod treated by the present invention has an improved drawability.

The present invention provides a method of direct heat treatment of a medium- to high-carbon steel rod by performing controlled cooling on an expanded spiral coil of a hot rolled medium- to high-carbon steel rod that has an austenitic structure and which is transported continuously in a generally horizontal direction. In order to perform this controlled cooling, the coil is passed through a vessel containing a coolant composed of a gas bubble-water mixed fluid under a strong turbulent action which contains a uniform dispersion of oxidizing gas bubbles and which is held at a predetermined temperature not higher than 95° C.

The steel rod that is to be treated by the present invention is a hot rolled rod that is made of a medium- to high-carbon steel or an alloy steel containing a small amount of an alloying element such as Ni, Cr, V, Mo or W.

The present inventors have conducted various studies to determine optimum conditions for surface treatment and coolants that are capable of achieving uniform cooling without inducing nucleate boiling and that ensure the necessary cooling rate for providing a rod strength comparable to that of a rod that has been patented through a lead bath. As a result of these studies, it has been found that a rod having a strength comparable to that of the lead-patented rod can be produced by first oxidizing the surface of a rod to a predetermined extent and then immersing the stock in a coolant made of a gas bubble-water mixed fluid which contains a dispersion of oxidizing gas bubbles and is at a temperature of not higher than 95° C. for the purpose of effecting chemical treatment to the rod surface and its cooling simultaneously. On the basis of this finding, the present inventors have also found that in the direct heat treatment of a steel rod by controlled cooling in which a spiral coil of the rod in its nonconcentrically expanded state is passed through the coolant continuously in a generally horizontal direction, it is effective for the purpose of uniform cooling of the entire length of the coil to cause the coolant to flow in the same direction as that in which the coil is moved.

DESCRIPTION OF THE PREFERRED EMBODIMENTS

The advantages of the present invention are described in detail by reference to the following experiments and examples.

EXPERIMENT 1

Figure 1:
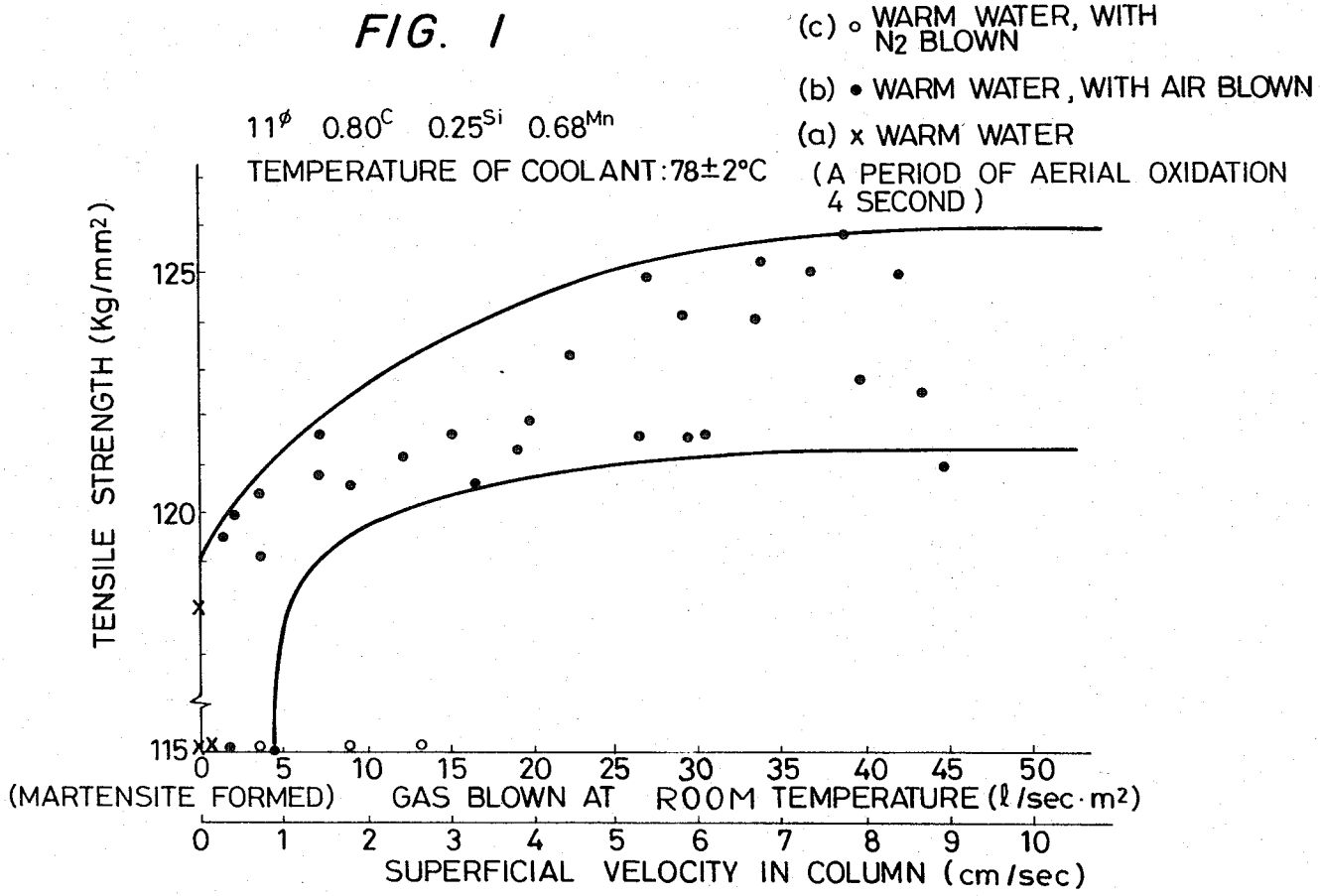
FIG. 1 is a graph showing test results of rod samples immersed in three different coolants.

Short rod samples (JIS: SWRH 82B) having a diameter of 11.0 mm and containing 0.8% C, 0.2% Si and 0.68% Mn were heated at 950° C. in a nonoxidizing atmosphere and thereafter subjected to atmospheric oxidation under actual operating conditions (i.e., cooling in air for 4 seconds). Then, the samples were immersed in the following three coolants at about 78° C. to check their effectiveness in controlled cooling: (a) warm water; (b) a gas bubble-water mixed fluid wherein air was blown into warm water to cause dispersion thereof, and (c) a gas bubble-water mixed fluid wherein nitrogen was blown into warm water to cause dispersion thereof. The test results are shown in FIG. 1. The warm water into which no gas was blown had a great tendency to cause nucleate-boiling and most of the rod samples treated by this cooling medium formed a martensite structure and did not have the desired strength. When 5 liters of air at room temperature was blown into the warm water per second over a unit area of 1 $m^2$, stable film boiling occurred and the turbulent action of the air bubbles provided an increased rod strength. However, this was not possible with nitrogen bubbling and the rod samples treated by the coolant (c) had an undesired martensite structure. For confirmation purposes, air was replaced by pure oxygen and the results were the sane as those obtained by using the coolant (b).

From these observations, it is concluded that stable film boiling can be maintained even in cooling with highly subcooled (78° C.) boiling water if a gas having an oxidizing action on steel such as atmospheric air, oxygen-rich air or oxygen (this kind of gas is hereunder referred to as an oxidizing gas) is blown into warm water in an amount exceeding a certain proportion with respect to the warm water and if bubbles of such oxidizing gas are dispersed in the warm water.

Figure 2:
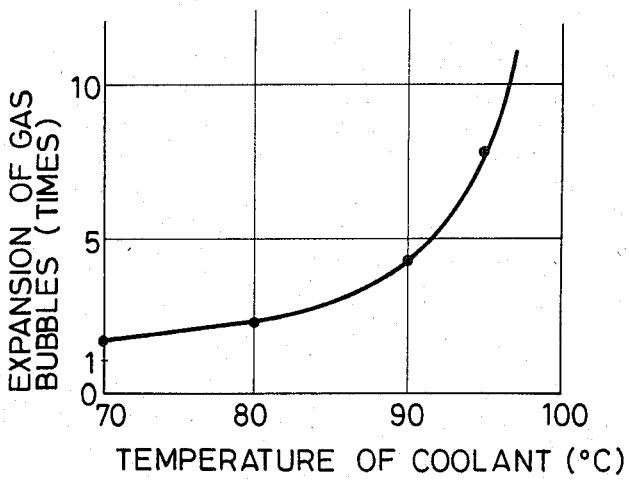
FIG. 2 is a graph showing the degree of expansion of gas bubbles as a function of the temperature of a coolant, containing the gas bubbles.

In Experiment 1, the volume of the gaseous phase in the gas bubble-water mixed fluid is expressed in terms of the amount of gas blown at room temperature. However, when the gas is blown into the warm water, the resulting bubbles are warmed up and the warm water evaporates into the bubbles until the equilibrium state is reached, and as a result, there occurs an almost instantaneous swelling of the bubbles as indicated in FIG. 2. Therefore, the volume of the gaseous phase in the gas bubble-water mixed fluid is preferably expressed in terms of the volume of swollen bubbles rather than the amount of gas blown at room temperature. More preferably, the superficial velocity in column (cm/sec), defined as the volume of a gas passing through a unit area of a liquid per unit time, is used to indicate the physicochemical properties of the gaseous phase in the gas bubble-water mixed fluid because in the latter case gas bubbles are eliminated from the fluid one after another by the action of buoyancy. According to FIG. 1, in order to ensure a rod strength comparable to that of the product patented through a lead bath, air at room temperature must be blown at a rate of 15 liters/sec·$m^2$ or more, and this corresponds to 30 liters/sec·$m^2$ or more in terms of the volume of air blown at a temperature equal to that of the warm water, and 3 cm/sec or more in terms of the superficial velocity in column. A superficial velocity in column faster than 20 cm/sec should be avoided because this will cause "channeling " (gas bubbles coalesce together to form a single gaseous phase). Therefore, a suitable superficial velocity in column is selected from the range of 3 to 20 cm/sec.

FIG. 1 also shows that the tensile strength of the rod samples that were cooled with fluid (b) increased with increasing superficial velocity in column, whereas no such tendency was observed with the samples treated by warm water (a). This is because an increase in the superficial velocity in column provides a turbulent action which leads to a higher heat transfer coefficient and hence to an enhanced cooling rate. If the superficial velocity in column is sufficiently high, the temperature of the coolant around the rod is held at an initially set value and a product having a high tensile strength corresponding to that set value can be obtained. On the other hand, if the superficial velocity in column is low, the flow of the coolant, which should circulate around the rod, becomes stagnant and the heat flux supplied from the rod increases the temperature of the coolant. This reduces the rate of cooling of the rod, and as a result, the tensile strength of the rod product is decreased correspondingly.

As can be seen from FIG. 1, the rod samples cooled by fluid (c) have an extremely low tensile strength. This is because warm water that was bubbled with nitrogen had a great tendency to cause nucleate boiling, and the resulting abnormal increase in the cooling rate contributed to the formation of a martensite structure.

Figure 15:
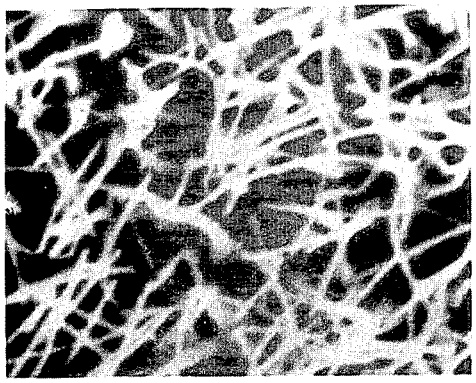
FIGS. 15 through 17 are a series of microphotographs showing scale formed on three different rod samples.
Figure 16:
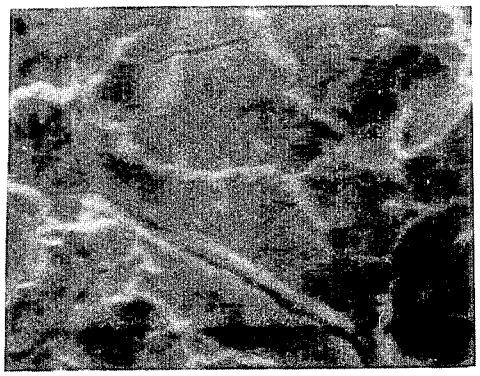
Figure 17:
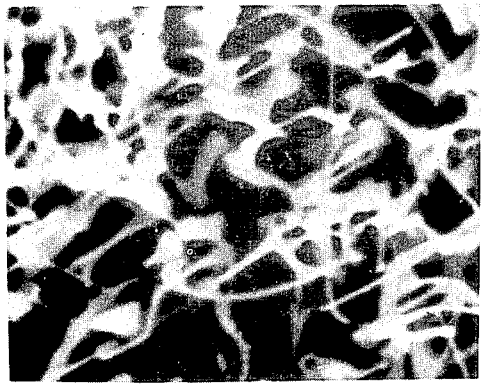

The scale forming on the rod samples that were treated with the gas bubble-water mixed fluid using an oxidizing gas had a color which visibly differed from the scale forming on the rod samples treated with simple warm water or nitrogen-bubbled warm water. In order to show this difference, rod samples were treated under the following three conditions, and pictures were taken of the scale forming on each sample by an SEM (scanning electron microscope). Representative microphotographs are shown in FIG. 15 (heated at 950° C. for 15 min in $N_2$ gas, oxidized with atmospheric air for 5.1 sec and treated with a gas bubble-water mixed fluid using Ar gas (for $N_2$ gas) at 93° C.), FIG. 16 (heated at 950° C. for 15 min in $N_2$ gas, oxidized with atmospheric air for 4.0 sec and treated with a gas bubble-water mixed fluid using air at 93° C.), and FIG. 17 (heated at 950° C. for 15 min in $N_2$ gas, oxidized with atmospheric air for 4.4 sec and treated with warm water at 93° C.). All samples were oxidized in the atmosphere for a period of about 4 seconds, which is generally understood to be most favorable for the formation of a martensitic structure (see Experiment 2 which follows). The samples other than those which were treated with the mixture of air and water as a coolant had whiskers on their surfaces, which would contribute to the nucleate boiling which occurred during the cooling step.

EXPERIMENT 2

This experiment was conducted to investigate the effect of the duration of oxidation that precedes the immersion of rods in the coolant. The size and material of the samples used in this experiment were the same as those selected for Experiment 1. The method of experiment was also the same as in Experiment 1. The test was carried out with air blowing at standard temperature at a rate of 3 cm/sec in terms of the superficial velocity in column. The following four durations of oxidation with air were selected: 0.5 sec, 3 to 5 sec, 10 sec and 15 sec. After oxidation, the samples were dipped in each of the coolants (70° to 100° C.) for 100 seconds. The profile of the temperature of each coolant vs. the tensile strength of the treated rods is shown in FIG. 3 for the four durations of oxidation.

Figure 3:
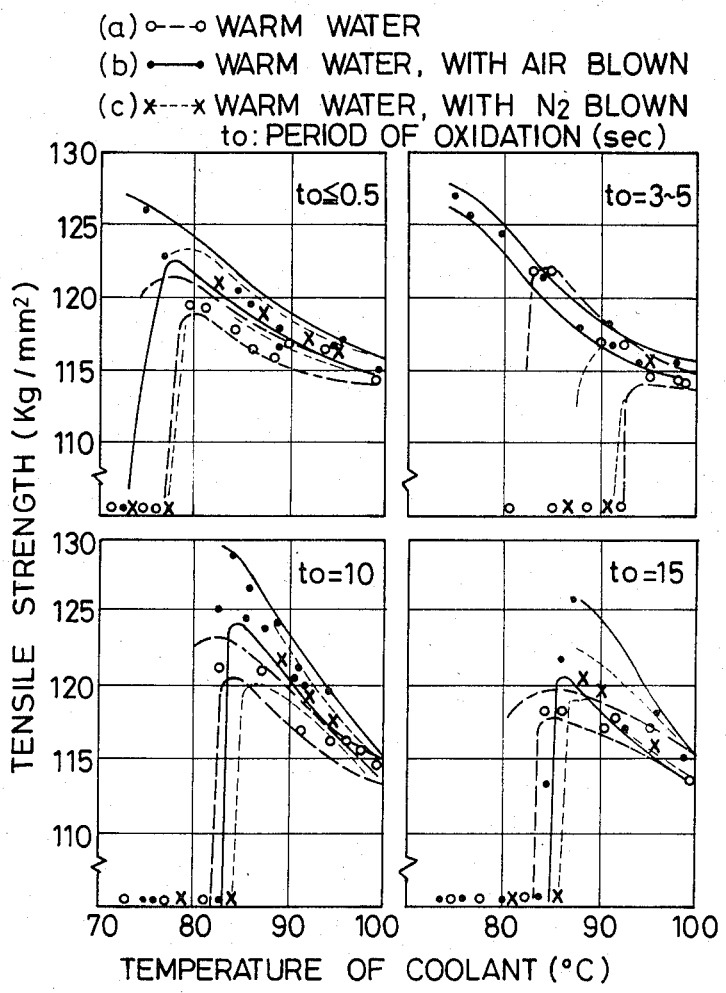
FIG. 3 is a set of graphs showing the tensile strength of treated rods as a function of temperature for four different durations of oxidation.

The following can be deduced from FIG. 3:

(i) The rod samples treated with gas bubble-water mixed fluids (b) and (c) had higher strengths than the samples simply treated with warm water (a).

(ii) With oxidation with air that lasted for not longer than 5 seconds, the gas bubble-water mixed fluid (b) using air as the oxidizing gas ensured stable film boiling and high-strength rods without causing nucleate-boiling before completion of the pearlitic transformation at a coolant temperature of 75° C. or higher. At about 80° C., a tensile strength of 125 kg/mm$^2$, almost equivalent to that of a lead-patented product, was attained. The strength of the rod samples treated with (b) increased with decreasing temperature of the coolant, and the rate of increase was higher than that for the case of treatment with warm water (a). The film boiling that occurred during the cooling with the gas bubble-water mixed liquid (c) using nitrogen as the non-oxidizing gas which forms weak oxidizing bubbles composed of nitrogen and water vapors was less stable than the one which occurred with the use of air in fluid (b), except 0.5 second (period of atmospheric oxidation). With oxidation in air that lasted for 3 seconds or longer, the cooling with warm water (a) induced nucleate boiling before completion of the pearlitic transformation at a coolant temperature of 90° C. or below, and the resulting local quenching caused a martensitic transformation, which led to a decrease in the strength of the rod samples. With oxidation that continued for not longer than 0.5 second, no martensitic structure was formed even at a coolant temperature of 80° C., but the product was not equivalent to a lead-patented product.

(iii) With gas bubble-water mixed fluids (b) and (c), the longer the duration of oxidation that preceded the immersion in the coolant, the greater the increase in the rod strength that occurred due to the decrease in the temperature of the coolant.

The above observations (i) to (iii) lead to the conclusion that the temperature of the coolant should generally be in the range of 70° to 95° C., preferably from 75° to 90° C., and that the duration of atmospheric oxidation that precedes the dipping in the coolant should be generally within 20 seconds in consideration of other experimental results. Below 70° C., nucleate boiling is highly likely to occur, and a martensite structure which leads to low strength is easily formed. If 95° C. is exceeded, the resulting rod strength is far from being satisfactory. Below 75° L C., the possibility of nucleate boiling is still substantial, and above 90° C., a rod strength comparable to that of the lead-patented rod is not attainable. If the duration of atmospheric oxidation exceeds 20 seconds, not only has the increase in the rod strength reached the saturation value, but also a considerable time is required to finish an entire heat treatment. Therefore, it is not economical to extend the atmospheric oxidation longer than 20 seconds. Atmospheric oxidation is performed by simply allowing the rod to cool in air. A special apparatus (e.g., conveyor) for this purpose is not necessarily needed since this cooling is normally realized while the rod coming out of the hot roll stand is coiled in preparation for dipping in the coolant.

Furthermore, it is necessary to limit the period of atmospheric oxidation within 0.5 second prior to the immersion into the coolant in which nitrogen gas, that is, an inert and nonoxidizing gas is blown. In this case, the rod strength is enhanced by effects of disturbance due to blowing of nitrogen gas, in comparison with the case of simple warm water. In the simple warm water case, water vapor bubbles generated when the rod is cooled vanishes immediately after separation from the surface of the rod, causing no disturbance effect. Therefore, the rod strength is rather lower.

EXPERIMENT 3

This experiment was conducted to determine the effect of the size of oxidizing gas bubbles on the tensile strength of rods. Short steel rods (JIS: SWRH 82B) having a diameter of 13 mm were subjected to controlled cooling in two types of coolants: one was a gas bubble-water mixed fluid prepared by simply blowing air into warm water; the other fluid was the same as the first one except that the blown air bubbles were broken into tiny segments by a fan or perforated rotary disk immersed in a coolant. The first type of fluid contained air bubbles of an average size of about 5 mm; some of them were as large as 10 mm or more. The second type of fluid contained air bubbles having an average size of about 1 mm. The test equipment was designed to provide air blowing at a rate of 3 cm/sec in terms of superficial velocity in column.

Figure 4:
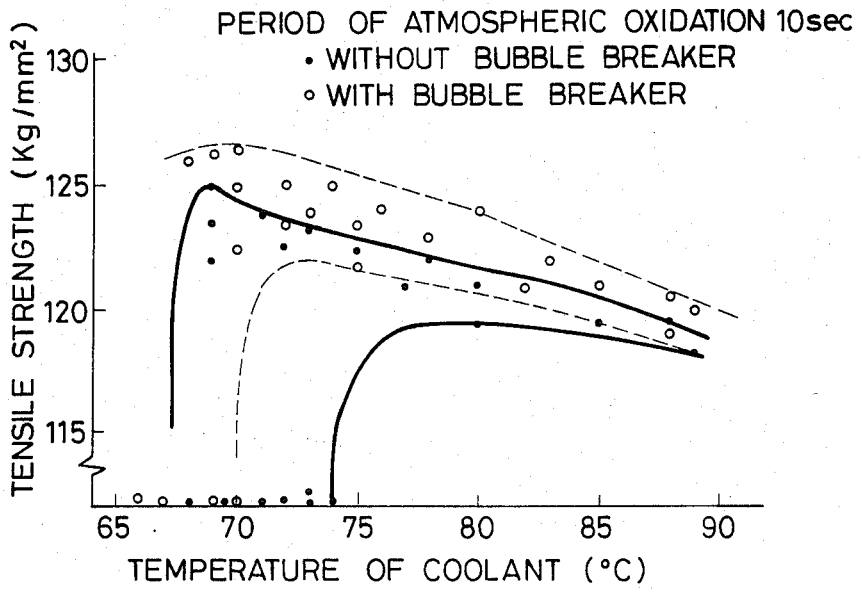
FIG. 4 is a graph showing test results from further experiments in which the size of the air bubbles dispersed in the coolant was varied.

The test results are shown in FIG. 4, from which it can easily be seen that the finer air bubbles assured stable film boiling and provided rods having a relatively high tensile strength.

The effect can be explained as follows: the finer bubbles are dispersed throughout the vessel to such an extent that they are uniformly entrapped by the film of vapor forming on the surface of each rod, and this provides an effective protection against nucleate boiling due to a broken vapor film. Another responsible factor would appear to be the revolving element of the bubble breaker, which upon its rotation agitates the coolant. This agitation may directly provide an increased rod strength and indirectly stabilize the vapor film on the rod by promoting the capture of air bubbles.

According to the results of Experiment 3, the use of fine gas bubbles having a uniform size distribution is effective in ensuring stable film boiling, and this effect is particularly great when a large vessel is used as the container of the gas bubble-water mixed fluid. For practical purposes, good results are obtained using gas bubbles of a size of about 1 mm.

EXPERIMENT 4

Figure 5:
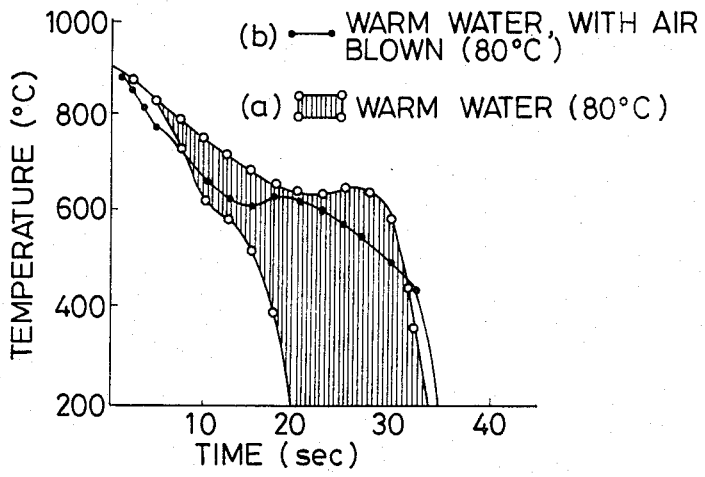
FIG. 5 is a plot of a cooling profile for a central portion of rod samples.

Steel rod samples (10 mm$\phi$) which were the same as those used in Experiment 1 were oxidized in the atmosphere for 4 seconds and subsequently dipped for varying periods in (a) warm water at 80° C. or (b) a gas bubble-water mixed fluid at 80° C. which was bubbled with air at a controlled rate of 3 cm/sec in terms of superficial velocity in column. The cooling curve for the central portion of each rod sample is shown in FIG. 5. As can be seen from FIG. 5, the gas bubble-water mixed fluid (b) using air as the oxidizing gas provided very stable cooling at the desired rate, and nucleate boiling always took place after completion of the pearlitic transformation and at temperatures not higher than 500° C. In contrast, the cooling with warm water (a) did not give highly reproducible results and the cooling rate varied greatly from one test run to another. This suggests that during cooling with warm water, nucleate boiling can easily occur at relatively high temperatures distributed over a wide range.

The most suitable rate of cooling rods should be properly determined by combining the observations obtained in Experiments 1 to 3. As shown in FIG. 5, it is preferred that the cooling rate be controlled at 15° to 25° C./sec for the rod temperature range of 900° to 650° C., and at 10° to 15° C./sec for the range of 630° to 500° C. after completion of the pearlitic transformation. If the cooling rate in the range of 900° to 650° C. is less than 15° C./sec, the transformation temperature is on the higher side and rods having sufficient strength cannot be obtained. If the cooling rate in the range of 900° to 650° C. is higher than 25° C./sec, the transformation temperature is on the lower side and part of the rod structure may undergo martensite transformation instead of pearlitic transformation. If the cooling rate in the range of 630° to 500° C. is less than 10° C./sec, an austenitic phase may be transformed to an insufficiently fine pearlitic structure, yielding a rod having low strength. There usually is no problem if the cooling rate in the range of 630° to 500° C. is higher than 20° C./sec, and the only exception is a steel having segregation, which often yields the undesired martensite structure. For rods made of alloy steels, the lower side of each of the ranges of cooling rate specified above is preferably used because alloy steels have increased hardenability. The pearlitic transformation begins at around 600° C. and the cooling rate must be 2 to 3 kcal/kg·sec. If the cooling rate is less than 2 kcal/kg·sec, the transformation temperature is shifted to the higher end and the resulting rod has a low strength. If the cooling rate exceeds 3 kcal/kg·sec, the transformation temperature is shifted to the lower end where the martensite transformation can easily occur.

EXPERIMENT 5

Figure 6:
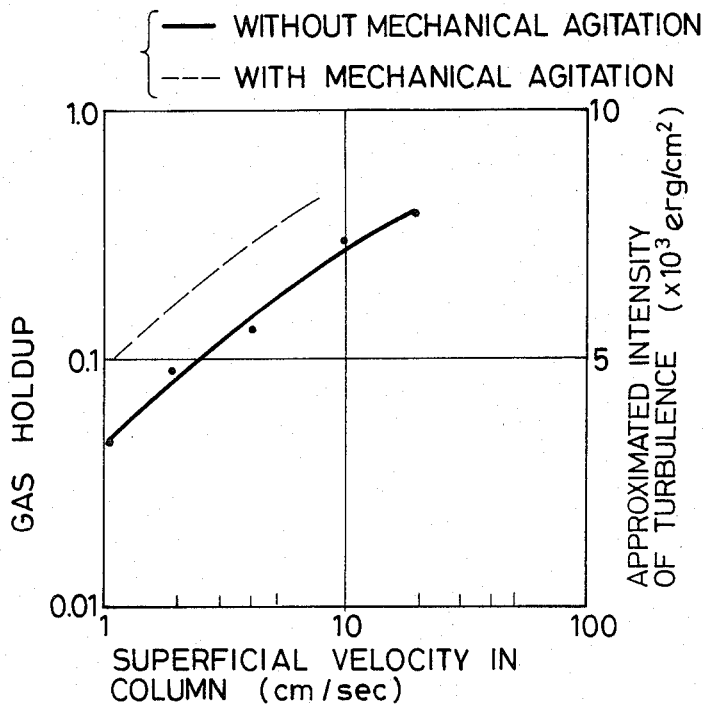
FIG. 6 is a graph plotting gas holdup and approximated intensity of turbulence against superficial velocity in column.

In this experiment, rod samples were cooled with the gas bubble-water mixed fluid (b) in either the presence or the absence of mechanical agitation. The relation of superficial velocity in column and the gas holdup (the volumetric ratio of gas to liquid in the cooling fluid) and the approximated intensity of turbulence is shown in FIG. 6. As can be seen from FIG. 6, as the superficial velocity in column varies from 3 to 20 cm/sec, the gas holdup and the approximated intensity of turbulence also increase from 0.1 to 0.35, and from 5 to $7\times10^3$ erg/cm$^2$ respectively. If the lower limits of the respective ranges are not reached, the gas bubble-water mixed fluid (b) is not capable of fully exhibiting its intended effect of providing a greater rod strength. If the upper limits are exceeded, "channeling" will occur.

EXPERIMENT 6

Figure 7:
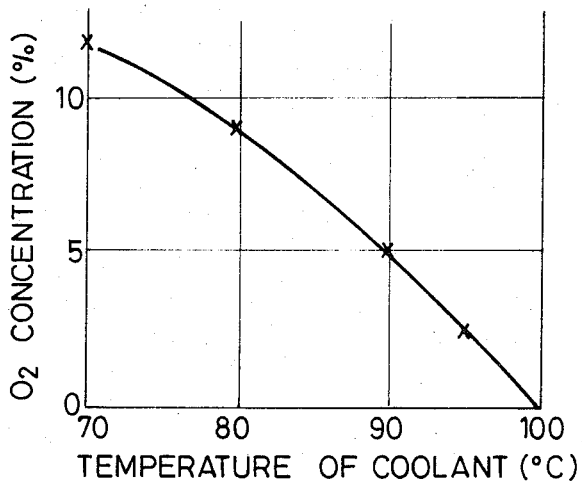
FIG. 7 is a graph plotting $O_2$ concentration versus the temperature of the coolant.

Steel rod samples were cooled with the gas bubble-water mixed fluid (b) and the profile of oxygen concentration for the coolant temperature range of 70° to 100° C. was checked. The results are shown in FIG. 7, from which it can be seen that a suitable concentration of oxygen in the oxidizing gas bubbles is 10% or more for a coolant temperature of 75° C., and 5% or more for a temperature of 90° C. This relation can be approximated by: $y \geqq -\frac{1}{3}x+35$, where y represents the concentration of oxygen (%) and x indicates the temperature of the coolant (°C.).

As soon as air is blown into warm water in order to prepare a coolant made of a gas bubble-water mixed fluid, water vapor enters the air bubbles and eventually saturates the space within the bubbles. As a result, the effective superficial velocity in column, or the turbulent action, of the air bubbles is increased. On the other hand, the concentration of oxygen is reduced, which is favorable for providing a greater agitating force and a higher gas holdup, but unfavorable for providing a greater oxidizing power. According to the results of Experiment 6, cooling that ensured the desired stable film boiling could be realized by selecting an oxygen concentration in the range defined above.

EXPERIMENT 7

The processing conditions shown in Experiments 1 to 6 are sufficient for attaining the primary object of the present invention, namely, providing a steel rod having a strength comparable to that of a lead-patented rod. However, if a faster roll finishing speed requires a higher rate of transporting the spiral coil of rod through the coolant, the coil has a greater speed relative to the coolant, and depending on the position in each turn of the coil expanded in a nonconcentric state, an excessive cooling rate may result in a rod having a martensitic structure. Experiment 7 was conducted to devise a method that could effectively prevent this excessive cooling rate.

Figure 8:
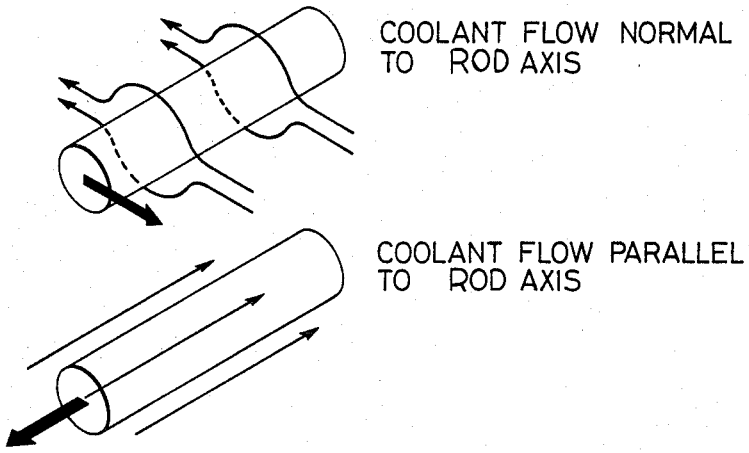
FIG. 8 is a diagram showing two principal directions of coolant flow.
Figure 9:
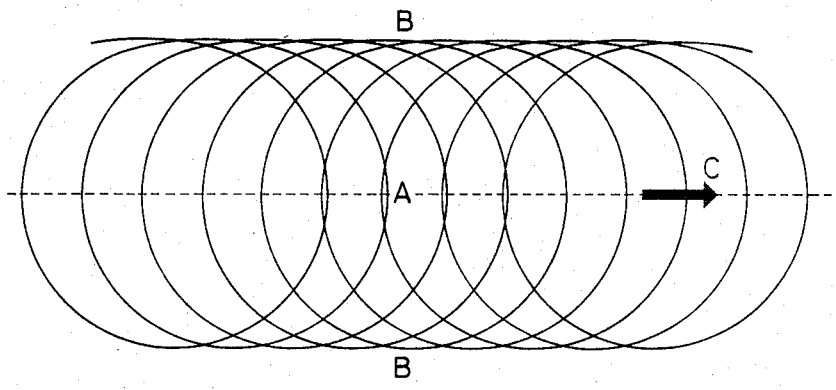
FIG. 9 shows a plan view of a spiral coil of rod in a nonconcentrically expanded state.
Figure 10:
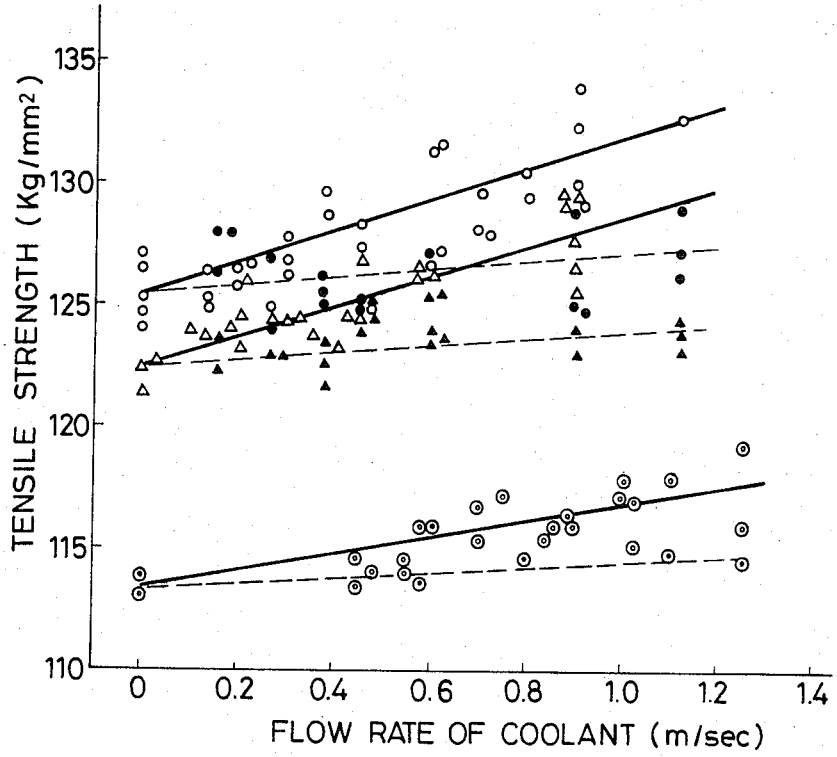
FIG. 10 is a graphical representation showing the effect of the flow rate of the coolant on the tensile strength of steel rod samples.

The coolant near a specific rod flows in two principal directions as seen in the plan view shown in FIG. 8. A spiral coil of rod in its nonconcentrically expanded state is shown in FIG. 9, wherein A indicates that part of the rod which is near the center zone in the widthwise direction of a sequence of the rings, and B indicates that part of the rod near the edge zone in the widthwise direction of rings. An arrow C indicates the direction of transport of the coil. FIG. 10 shows the effect of the flow rate of the coolant on the tensile strength of steel rod samples that were heat treated by the coolant according to the present invention. As shown in FIG. 10, when the flow rate of the coolant is increased, the rod strength is also increased despite the turbulence by air bubbles; in terms of actual operation, the amount of increase in rod strength is significantly great when the coolant flows in a direction normal to the rod's axis (as indicated by A in FIG. 9) and small when the direction of the coolant flow is parallel to the rod's axis (as shown by B in FIG. 9). This is an undesired phenomenon since it produces a coil of rod whose strength varies depending upon the specific position in each turn of the coil. A particularly great variation in rod strength occurs if the temperature of the coolant is low. Therefore, in order to provide a more uniform structure and strength for the rod along the entire length of the coil, the speed of the coolant relative to the spiral coil must be confined within the proper range by circulating the coolant in the heat treating vessel in the same direction as the direction of transport of the spiral coil.

Figure 11:
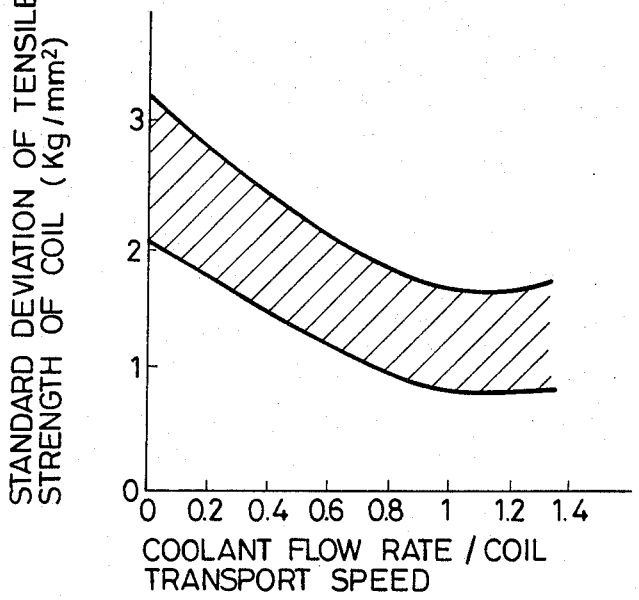
FIG. 11 shows the amount of deviation in rod strength as a function of a ratio of the flow rate of the coolant to the transport speed of a spiral coil.

FIG. 11 shows a profile of the flow rate of the coolant relative to the transport speed of the spiral coil. Obviously, the amount of deviation in the rod strength with respect to the position of each turn of the coil is a minimum in the range where the two speeds are substantially equal. The flow rate of the coolant should be properly determined according to the desired rod strength. Circulating the coolant is effective not only for minimizing the amount of deviation in rod strength, but also for maintaining the temperature of the coolant at a constant level.

The processing conditions used in Experiments 1 to 7 and that can be used in the present invention should be optimized by properly considering various factors such as the type of steel of the rod, its diameter, the diameter of each turn of the coil, the rate at which the rod is fed, the volume of the coolant, the type of the oxidizing gas, and the length of the vessel containing the coolant.

EXAMPLE 1

Figure 12:
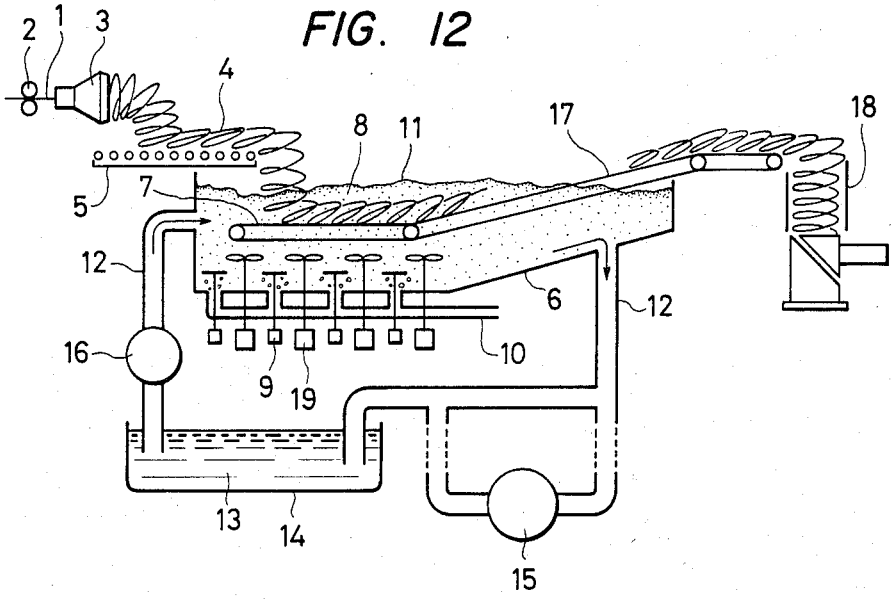
FIG. 12 is a schematic cross-sectional view of an apparatus implementing the method of direct heat treatment of the invention.

An apparatus for implementing the method of direct heat treatment of the present invention is shown schematically in FIG. 12. A rolled steel rod 1 leaving pinch rolls 2 is passed through a laying head 3 to form a spiral coil 4 having a predetermined coil diameter. The coil, in the form of a sequence of nonconcentric rings, is subjected to preliminary cooling as it is transported on a conveyor 5. During this preliminary cooling for a predetermined period, the surface of each turn of the coil 4 is oxidized in the atmosphere.

After the preliminary cooling, the coil 4 is transferred onto a horizontal conveyor 7 in a heat treating vessel 6 and transported horizontally in its horizontally expanded form. The vessel 6 is filled with a coolant 8 in which the coil 4 on the conveyor 7 is immersed for a predetermined period. The coolant 8 is a gas bubble-water mixed fluid which is strongly agitated and which contains a uniform dispersion in warm water of oxidative gas bubbles 11 having an average size of about 1 mm. The coolant is held at a predetermined temperature not higher than 95° C. The oxidative gas bubbles 11 are typically composed of oxygen or an oxygen-containing gas such as oxygen-rich air or atmospheric air and water vapor, and occasionally composed of nitrogen and water vapor.

In order to prepare a gas bubble-water mixed fluid wherein the oxidative bubbles 11 each having a diameter of about 1 mm are uniformly dispersed in warm water, the apparatus shown in FIG. 12 is equipped with a gas supplying system 10 through which a large volume of air is blown into the warm water from below so as to form air bubbles. The apparatus is also provided with bubble breakers, typically in the form of rotary fans 9, which not only break up the air bubbles into tiny segments each having a diameter of about 1 mm, but also disperse such bubbles uniformly in the warm water. The fans may be replaced by perforated rotary disks. The gas supplying system 10 may be so designed that the gas is blown into the warm water either from above or from the side. If desired, a gas bubble-water mixed fluid having a uniform dispersion of oxidative bubbles in warm water may be prepared outside of the vessel 6 and then fed into the vessel from the top, side or bottom.

The coolant 8 in the heat treating vessel 6 is vigorously agitated by a plurality of agitators 19. As a result, the coil 4 is subjected to the desired controlled cooling with the coolant made of the vigorously agitated gas bubble-water mixed fluid. The agitators 19 may be replaced by the rotary fans 9 which have an agitating ability.

The turns of the horizontally expanded coil 4 overlap each other more closely at portion B (see FIG. 9) than at the central portion (A in FIG. 9). Therefore, in order to ensure a uniform cooling rate, portion B of each turn of the coil is subjected to a more powerful cooling than portion A. This may be realized by, for example, providing a more vigorous agitation for portion B.

The apparatus of FIG. 12 is also equipped with a coolant circulation system which reduces the relative speed of the spiral coil by causing the coolant to flow in the same direction as the direction of transport of the coil. This system includes a vessel 14 filled with warm water 13 held at a predetermined temperature, a feed pipe 12 and a pump 16. This system may be further provided with a heat exchanger 15 on a bypass line for the purpose of maintaining the temperature of the coolant at a predetermined level.

The coil 4 which has been subjected to controlled cooling for a predetermined duration is recovered from the coolant 8 by means of an inclined conveyor 17 and accumulated in a collector 18.

EXAMPLE 2

Hot rolled steel rod samples (JIS: SWRH 82B, 11.0 mmϕ, 300 kg in weight) containing 0.82% C, 0.72% Mn and 0.22% Si were subjected to direct heat treatment according to the method of the present invention using an apparatus of the type shown in FIG. 12. The rolling speed was 9 m/sec, and the temperature of the samples as rolled was 920° C. After preliminary cooling to 850° C. with high pressure water squirted from nozzles, the samples were shaped into spiral coils with a ring diameter of 1,050 mm. Two types of coolant held at 82° C. were used: one was a gas bubble-water mixed fluid prepared by simply blowing air into warm water, and the other was a gas bubble-water mixed fluid wherein the air bubbles were broken up into tiny segments. In either case, air was blown at a rate of 10 cm/sec in terms of superficial velocity in column, and each mixed fluid had a gas holdup of about 0.2 The travelling speed of the conveyor 7 through the vessel was 0.4 m/sec. The coolant was caused to flow at about 0.4 m/sec in the direction of transport of the spiral coils.

After atmospheric oxidation that lasted for about 10 seconds, the spiral coils were immersed in the vessel 6 for about 25 seconds and recovered from the vessel for accumulation in the collector 18.

For the sake of comparison, hot rolled rod samples having the same specification as above were heat treated by the conventional direct method wherein they were immersed in warm water held at 98° C.

Figure 13:
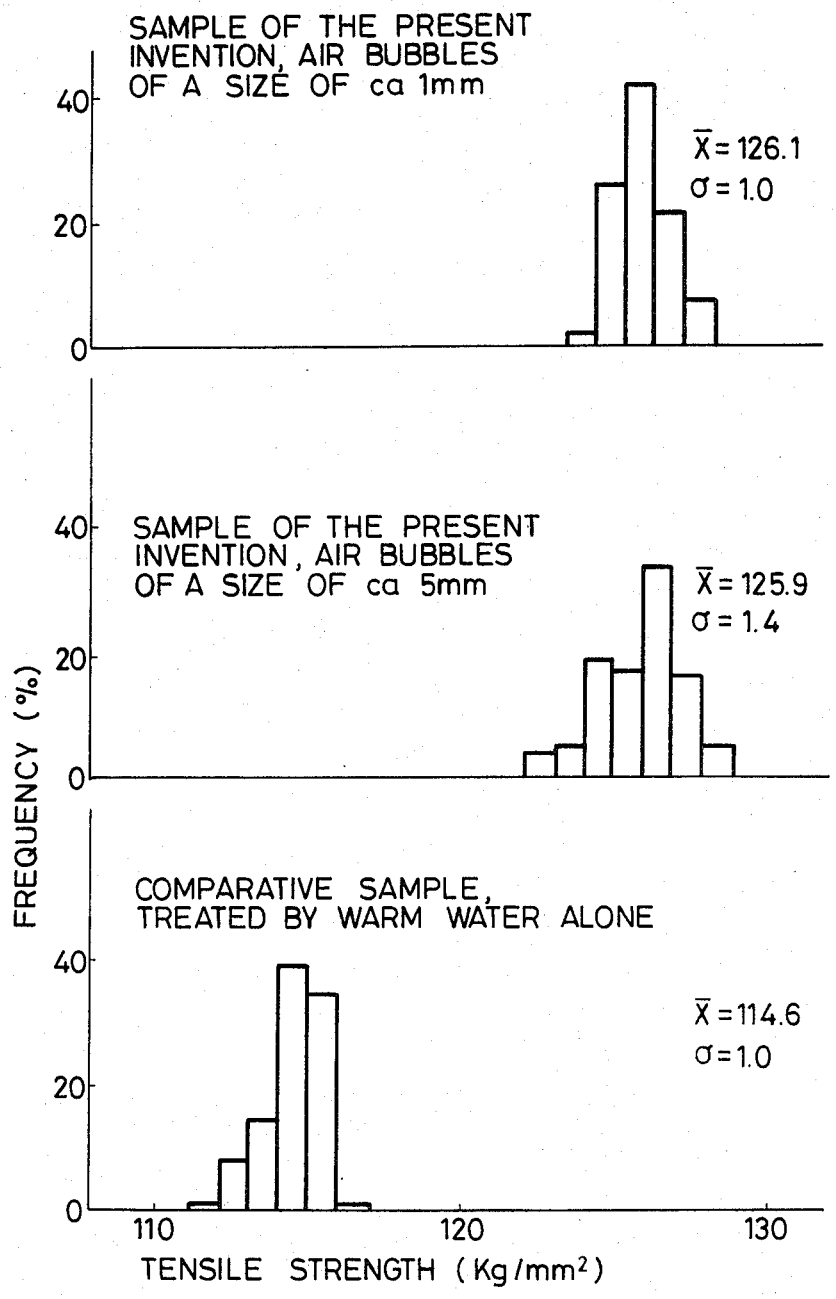
FIG. 13 is a series of histograms of the tensile strength of various coil samples.

The coil thus obtained was checked for tensile strength by continuous sampling at five points which included both end points of the coil and which were located such that the coil was thereby divided into four equal sections. A histogram of the tensile strength of each coil sample is shown in FIG. 13, from which it can be seen that the rod samples treated by the present invention had an average tensile stength of 126 kg/mm$^2$ and the distribution of tensile strength values was highly uniform. Particularly good results were obtained by using finely divided air bubbles. However, the tensile strength of the samples treated by the conventional method of direct heat treatment using only warm water was about 11 kg/mm$^2$ lower on the average.

EXAMPLE 3

Figure 14:
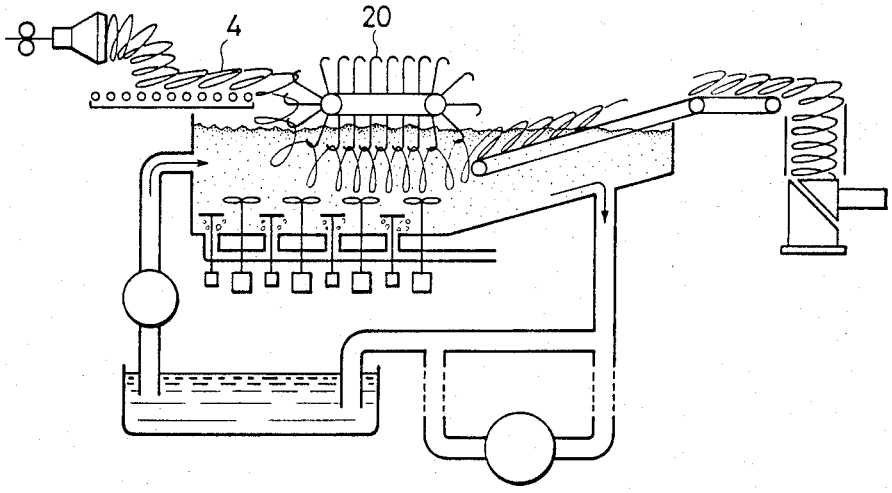
FIG. 14 is a schematic view of another apparatus implementing the method of the invention.

FIG. 14 schematically shows another apparatus for implementing the method of the present invention. A spiral coil 4 is expanded in its vertically hung down form and transported in a substantially horizontal direction in a coolant. Since the spiral coil 4 is hung from a hook of a hooking conveyor 20, the spiral coil can be uniformly cooled because the turns of the coil do not overlap one another.

As shown in FIG. 14, the coolant 8 is circulated in a direction parallel to the direction of transport of the coil. However, it is possible to circulate the coolant in the opposite direction or not to circulate it at all. Furthermore, a combination of a hooking conveyor and horizontal conveyor can be used.

A solution or suspension containing a surfactant can be used in place of the warm water, which varies the heat transfer coefficient during cooling. For example, if PVA as a surfactant is incorporated in the warm water, the dispersion of bubbles is more uniform and the gas holdup is smoothly enhanced, resulting in stable film-boiling.

The method of direct heat treatment of steel rods according to the present invention has the following advantages:

(1) The method performs controlled cooling by passing a spiral coil of the steel rod through a vessel containing a coolant of a gas bubble-water mixed fluid under a vigorous turbulent action which is held at a predetermined temperature not higher than 95° C. and which contains a uniform dispersion of oxidizing gas bubbles. The rod is cooled with the oxidizing bubble-containing gas-water mixed fluid after or while an oxide film is formed on the rod surface as it is exposed to the open air or left to cool in the open air immediately after the hot rolling, or oxidized by the bubbles in the coolant. Therefore, the desired cooling rate can be obtained with consistent results, and no nucleate boiling will occur even if subcooled boiling water is used as part of the coolant. Furthermore, the coolant is caused to flow at a suitable speed in the same direction as the direction of transport of the spiral coil, which eliminates variations in the cooling conditions that would otherwise occur within the coil due to the difference in speed between the coil and coolant. For these reasons, the method of the present invention is capable of producing a steel rod of high drawability that has a tensile strength comparable to that of a lead-patented rod and which has a small variation in tensile strength.

(2) In order to prepare the gas bubble-water mixed fluid containing a uniform dispersion of oxidizing gas bubbles, a large volume of a gas that is not saturated with water vapor is introduced into warm water. This causes a great amount of water vapor to enter the gas bubbles until the equilibrium vapor pressure is reached, and as a result, a large amount of heat is removed from the coolant to lower its temperature. In other words, the coolant has a self-cooling property, which can be used effectively to perform control over its temperature. This provides an economical means for maintaining the temperature of the coolant at a desired level. The self-cooling ability of the coolant can be readily determined by calculating the ratio of the throughput of the rod (tons/hr) to the temperature of the coolant.

Furthermore, if the gas introduced into the coolant is preheated and its temperature enhanced in order to vary the vapor pressure of the gas, the self-cooling ability can be varied.

We claim:

1. In a method of direct heat treatment of a medium- to high-carbon steel rod by performing controlled cooling on an expanded spiral coil of a hot rolled steel rod that has an austenitic structure and which is being transported continously in a generally horizontal direction, the improvement wherein the spiral coil is passed through vessel containing a coolant of a gas bubble-water mixed fluid under a strong turbulent action which contains a uniform dispersion of oxidizing gas bubbles and which is at a temperature not higher than 95° C., whereby uniform cooling conditions for the coil are provided along its entire length.

2. The method according to claim 1, wherein the coolant is caused to flow at a predetermined rate in the same direction as the direction of movement of said coil in said vessel, whereby uniform cooling conditions for the coil are provided along its entire length.

3. The method according to claim 2, wherein the coolant is caused to flow at a rate which is substantially equal to the transport speed of the coil.

4. The method according to claim 1, wherein the oxidizing gas bubbles have a diameter of approximately 1 mm.

5. The method according to any one of claims 1 through 4, wherein the surface of the steel rod is oxidized by allowing it to cool in air for a period of no more than about 20 seconds before it is immersed in the coolant.

6. The method according to any one of claims 1 through 4, wherein the oxidizing gas bubbles contain water vapor and at least one of oxygen, oxygen-rich air, and atmospheric air, and wherein the oxygen concentration y in the bubbles is represented by:

$$y \geqq \tfrac{1}{3}x + 35,$$

where x is the temperature of the cooling (°C.).

7. The method according to any one of claims 1 through 4, wherein the oxidizing gas bubbles contain water vapor and an inert gas.

8. The method according to any one of claims 1 through 4, wherein the surface of the steel rod is oxidized in air for a period of no more than about 0.5 second before its immersion into the coolant.

9. The method according to any one of claims 1 through 4, wherein said gas bubble-water mixed fluid has a gas holdup of 0.1 to 0.35 and a superficial velocity in column of 3 to 20 cm/sec.

10. The method according to any one of claims 1 through 4, wherein the coolant is given a turbulent action having an intensity of 5 to $7\times10^3$ erg/cm$^2$.

11. The method according to any one of claims 1 through 4, wherein the temperature of the coolant is in a range of 70° to 95° C.

12. The method according to any one of claims 1 through 4, wherein the temperature of the coolant is in a range of 75° to 90° C.

13. The method according to any one of claims 1 through 4, wherein the steel rod is cooled at a rate of 15° to 25° C./sec in a temperature range of 900° to 650° C.

14. The method according to any one of claims 1 through 4, wherein gas bubbles uniformly dispersed in warm water are formed primarily by a bubble breaker positioned near gas blowing means disposed in the vessel.

15. The method according to any one of claims 1 through 4, wherein gas bubbles uniformly dispersed in warm water are formed previous to or simultaneously with the warm water being supplied to the vessel.

16. The method according to any one of claims 1 through 4, wherein water of the gas bubble-water mixed fluid comprises a solution or suspension including a substance for varying the heat transfer coefficient of said water.

17. The method according to any one of claims 1 through 4, wherein the gas of the gas bubbles is preheated.

18. A direct heat treatment apparatus for a medium- to high-carbon steel rod, comprising:

a laying head for forming a spiral coil from a rolled high-temperature rod;

a heat treatment vessel for storing the rod to be cooled, said vessel being filled with an oxidative gas bubble-water mixed fluid;

at least one means for immersing, transporting and extending the spiral rod in and out the vessel;

agitating means for agitating the mixed fluid in the vessel; and means for fluidizing and circulating the gas-water mixed fluid in a direction parallel to the direction of transportation of the rod.

19. The apparatus according to claim 18, wherein said at least one means comprises a horizontal conveyor.

20. The apparatus according to claim 18, wherein said at least one means comprises a hooking conveyor for vertically suspending coils of the rod.

21. The apparatus according to claim 18, wherein said at least one means comprises a horizontal conveyor and a hooking conveyor.

22. The apparatus according to claim 18, further comprising gas blowing means for blowing gas into the vessel and a gas bubbles breaking device disposed between said gas blowing means and said rod in the vessel.

23. The apparatus according to claim 22, wherein said gas blowing means and said gas bubbles breaking device are disposed at the bottom of the vessel.

24. The apparatus according to either one of claims 18 and 22, further comprising means for controlling an amount of a gas or a water vapor mixed gas and a mixture ratio thereof so as to blow the controlled gas into the vessel.

25. The apparatus according to either one of claims 18 and 22, wherein said gas bubbles breaking means comprises a perforated rotary disk or a rotary fan.

26. The apparatus according to either one of claims 18 and 22, wherein said gas bubbles breaking means comprises means for agitating the mixed fluid.

27. The apparatus according to either one of claims 18 and 22, further comprising means for selectively cooling and heating the warm water so as to control the temperature of the gas bubble-water mixed fluid and cool the rod.

28. The apparatus according to either one of claims 27, wherein said means for cooling and heating the warm water is included in said fluidizing and circulating means.

29. The apparatus according to either one of claims 18 and 22, further comprising a precooling device disposed between said laying head and said vessel.

* * * * *